United States Patent [19]

Chabala

[11] 4,319,108

[45] Mar. 9, 1982

[54] FORCE-LIMITING COUPLING APPARATUS

[75] Inventor: Leonard V. Chabala, Maywood, Ill.

[73] Assignee: S&C Electric Company, Chicago, Ill.

[21] Appl. No.: 237,226

[22] Filed: Feb. 23, 1981

[51] Int. Cl.[3] ..... H01H 9/00

[52] U.S. Cl. ..... 200/308

[58] Field of Search ..... 200/153 SC, 308, 153 HS, 200/63 R, 50 AA; 74/97, 599, 581, 582, 470; 335/190

[56] References Cited

U.S. PATENT DOCUMENTS

| | | | |
|---|---|---|---|
| 2,909,940 | 10/1959 | Dawkins | 74/470 |
| 3,055,227 | 9/1962 | Martin | 74/470 |
| 4,180,788 | 12/1979 | Barkan | 335/190 |
| 4,238,657 | 12/1980 | Opfer et al. | 200/308 |

*Primary Examiner*—Willis Little

*Attorney, Agent, or Firm*—John D. Kaufman

[57] ABSTRACT

A close-wound coil spring moves a driven member in response to movement of a drive member. The spring is moved when one end thereof receives transverse force from the moving drive member; the other end of the moving spring transversely applies force to the driven member. If the transverse forces on the spring are less than a given amount, as when the driven member moves relatively slowly, the spring acts as a rigid lever capable of moving the driven member synchronously with, and during the same time interval as, the drive member. If the transverse forces on the spring exceed the given amount, as when the driven member moves suddenly or at high speed, the spring flexes according to Hooke's Law and moves the driven member asynchronously with, and during a different time interval from, the drive member. In the latter case, the spring's flexure limits the force applied to the driven member, preventing damage thereto.

16 Claims, 6 Drawing Figures

FORCE-LIMITING COUPLING APPARATUS

BACKGROUND OF THE INVENTION

1. Field of the Invention

The present invention relates to a force-limiting coupling apparatus, and more specifically, to apparatus for translating the movement of a drive member, which may move suddenly at high speed, to movement of a driven member in such a manner that forces applied to the driven member do not attain values at which damage thereto, to the drive member, or to the apparatus may occur.

2. Prior Art

Many devices have parts which move at high speed. An example of one such device is high-voltage switchgear of a certain type. High-voltage switchgear may include one or more high-voltage switches rapidly movable between opened and closed positions by stored-energy operating mechanisms which include a massive spring. Rapid movement of the switches between opened and closed positions is necessary or desirable, because such switches are often expected to have the capabilities of opening to interrupt load or fault currents or closing under fault conditions. Rapid movement of the switches is one factor in determining whether or not the switches are capable of successfully operating—opening and closing—under load and fault conditions. The spring of the operating mechanism may have potential energy stored therein by either manipulation of a crank handle or the momentary energization of a motor. Once potential energy is stored in the massive spring, the switches are opened or closed by selective release of the potential energy. The release of this energy may be in response to circuit conditions (as detected by appropriate sensors), to a remote signal, or to manual operation of a latch. The release of the stored potential energy from the massive spring effects a rapid and mechanically violent movement of switchblades of the switches during the opening and closure thereof.

Often, high-voltage switches are contained within metal enclosures or cubicles. The enclosures are present to protect the switches, the operating mechanisms, and other portions of the switchgear from the elements, as well as to prevent inadvertent contact by personnel with energized live parts of the switchgear. As a consequence of the use of such enclosures, the condition of various portions of the switchgear may not, without additional steps being taken, be readily apparent to operating personnel. Included in these conditions are the state—opened or closed—of the switches, as well as the state—charged or uncharged—of the operating mechanism for the switches. In many use environments of high-voltage switchgear, it may be desirable that operating personnel be able to ascertain the condition of the switches or of the switch operating mechanisms (or both) without opening normally-closed doors of the enclosures. Examples of the above-described high-voltage switchgear and of apparatus which permits personnel to determine the condition of the switches and of the operating mechanisms therefor without opening the enclosure doors are disclosed in commonly-assigned U.S. Pat. Nos. 4,190,755 and 4,206,329 and in the following commonly-assigned U.S. Patent applications: Ser. No. 136,632 filed Apr. 1, 1980; Ser. No. 922,326 filed July 6, 1978; and Ser. No. 911,123 filed May 31, 1978.

The switchblades of high-voltage switches may be mounted to shafts, rotation of which rotates the switchblades into and out of engagement with stationary contacts for closing and opening the switches. The shaft of each switchblade is rotated at extremely high speeds by an output shaft of the operating mechanism. As noted earlier, it may be desirable to determine conditions such as the open or closed state of the switches from outside of the enclosure. Accordingly, the above patents and applications describe apparatus which is mechanically coupled to either the output shaft of the operating mechanisms or to the switch shafts for indicating their rotational position. Such indicators may comprise a movable or rotatable disk or plate which contains thereon legends, such as, "switch open" and "switch closed." The appropriate legend is viewable through a window formed through a wall of the enclosure depending upon the position of either the output shaft of the operating mechanism or the switch shaft.

It is well known to directly mechanically couple either of the shafts to the indicating disk. It has been found, however, that due to the rapid, somewhat violent motion of these shafts, the indicating disks, which need not be more than lightweight members, or other parts of the indicating apparatus, are often damaged. Such damage may involve deformation of the disk, degredation of bearings on which the disk rotates, or deformation and breakage of the mechanical coupling between the shafts and the indicating disks. Any damage may well prevent the indicating disk from accurately indicating the condition of a switch or of an operating mechanism therefor.

Accordingly, a general object of the present invention is the provision of a force-limiting coupling. A more specific object hereof is to provide a coupling between the above-described shafts and their indicating disk which limits the amount of force applied to the disks so that damage thereto is obviated and so that the disks may continuously, accurately indicate conditions of the switch or its operating mechanism.

SUMMARY OF THE INVENTION

With the above and other objects in view, the present invention contemplates force-limiting coupling apparatus for moving a driven member in response to movement of a drive member. The drive member may move suddenly at high velocity between first and second rest positions. The driven member is movable between first and second positions which uniquely, respectively correspond to the first and second rest positions of the drive member. The apparatus prevents forces applied to the driven member from exceeding a predetermined value so that damage thereto is obviated.

The apparatus includes a connecting link which has first and second separated sites thereon. The first site is moved between first and second locations by the drive member moving between its first and second positions. The driven member is moved between its first and second positions by the second site moving between first and second locations. A member interconnects the sites and moves the second site between its first and second locations in response to movement of the first site between its first and second locations in one of two ways. First, if the first site is moved by the driven member at a velocity less than a predetermined value, the second site moves therewith synchronously—at the same time and rate—and isochronously—during an equal interval of time. Second, if the velocity of the first site exceeds the predetermined value, the second site moves therewith asynchronously—at a different time and rate—and heterochronously—during a different interval of time. In specific embodiments, the interconnecting member is a spring with a normal configuration. If the velocity of the first site is less than the predetermined value, the spring remains in its normal configuration, and acts as a rigid member. If the velocity of the first site exceeds the predetermined value, the spring acts as a non-rigid member and is distorted out of its normal configuration to store energy therein as the first site moves. Following the storage of energy in the spring, the stored energy is released, which returns the spring to its normal configuration and moves the second site. Stated differently, the spring may act both as a rigid lever between the sites, which move in step, and as a flexible, energy-absorbing, force-limiting lever between the sites, which move out of step, movement of the second site lagging behind, but ultimately corresponding to, the movement of the first site.

In preferred embodiments, the spring is a close-wound coil spring, the distortion of which is characterized by transverse flexure and bending thereof. The spring is wound with an "initial tension" so that at rest or during movement at which a velocity is less than the predetermined value, the spring exhibits well-defined rigid-member-like action; when the spring moves at a velocity in excess of a predetermined value, it bends or flexes according to Hooke's Law. The drive member may be a rotational shaft, such as a shaft of a high-voltage switch or an output shaft of a stored-energy operating mechanism for a high-voltage switch, and one end of the spring may be mounted to the shaft for transverse rotation thereof. The driven member may be either reciprocable or rotatable and may be connected to, or may lie on the rotative path of, the other end of the spring. The driven member may be an indicating disk bearing legends thereon to inform of the condition of the switch or of its operating mechanism.

DETAILED DESCRIPTION

Figure 1:
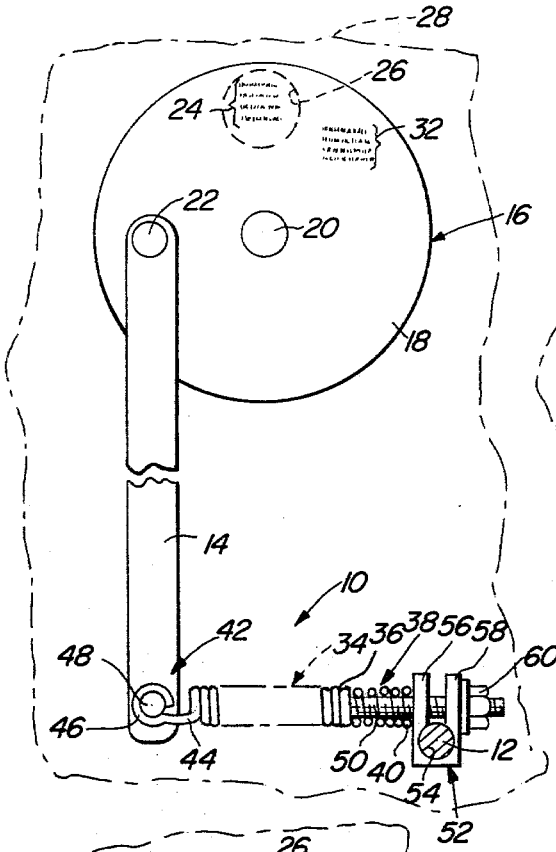
FIG. 1 is a top view of force-limiting coupling apparatus according to the present invention and in its normal condition.

Force-limiting coupling apparatus 10, according to the present invention, is depicted in FIG. 1. The apparatus 10 is used to couple together a drive member, such as a rotatable drive shaft 12, and a driven member, such as a rotatable or reciprocable link 14. The object of using the apparatus 10 is to ensure that the driven member 14 moves in response to movement of the drive member 12, while limiting the amount of force applied to the driven member 14 so as to prevent damage thereto, as well as to the drive member 12 and the apparatus 10.

The drive shaft 12 may form a portion of, or be connected to, a strut mounting switchblades of a high-voltage switch (not shown) or an output shaft of an operating mechanism (not shown) for the strut. The type of switch and operating mechanism of which the drive shaft 12 may form a part, or to which it may be connected, are more specifically shown and described in the above-noted, commonly-assigned patents and patent applications. Suffice it here to say that whether the drive shaft 12 forms a portion of or is connected to the switch shaft or the output shaft, its movement from the position shown in FIG. 1 to the positions shown in FIGS. 2*a* or 2*b* may be both rapid and violent, for reasons previously set forth.

The link 14 may form a portion of, or be connected to, an indicator generally indicated at 16. The function of the indicator 16 is to inform operating personnel of the position of the drive shaft 12 and, consequently, of the position of either the switch shaft or the output shaft of the operating mechanism for the switch. A specific type of indicator 16 is illustrated in FIG. 1, it being understood that other types of indicators having different arrangements of parts are also contemplated by the present invention.

The indicator 16 includes a low mass disk 18 rotatable on a pin or stud 20. The link 14 is pivotally mounted to the disk 18 by a pin or stud 22. Downward movement of the link 14 from its position shown in FIG. 1 rotates the disk 18 counterclockwise. In the normal position of the disk 18, a first legend or indicia 24 on the disk 18 is visible through a window 26 formed through an exterior side wall 28 of an enclosure. In preferred embodiments, where the drive shaft 12 forms a part of, or is connected to, either a switch shaft or the output shaft of an operating mechanism for the switch, the enclosure contains and protects, but also prevents, the visual observation of the condition of, the switch and the operating mechanism. The legend 24 may, for example, inform that in the condition of the elements shown in FIG. 1, the switch is closed. It is assumed that counterclockwise rotation of the drive shaft 12 occurs when the switch moves from its closed position to its open position. In this event, it is desired that the link 14 move downwardly to rotate the disk 18 counterclockwise. Counterclockwise rotation of the disk 18 carries the legend 24 away from the window 26 and positions behind the window 26 another legend 32 which informs that the switch is now open.

Because the movement of the drive shaft 12 is rapid and because the only crucial positions of the link 14 are those end positions which determine which of the legends 24 or 32 are viewable through the window 26, the link 14 need not move simultaneously, synchronously, or isochronously with the drive shaft 12. Stated differently, the link 14 need only occupy either end position so that one of the legends 24 or 32 is visible through the window 26; the occupation of either end position may occur some time after the drive shaft 12 assumes its corresponding end position. As noted previously, it is also desired, however, that the apparatus 10 limit the force applied to the link 14 so that neither the link 14, the pins 20 or 22, or the disk 18 are damaged or deformed due to the rapidity and violence of the rotation of the drive shaft 12.

Figure 3:
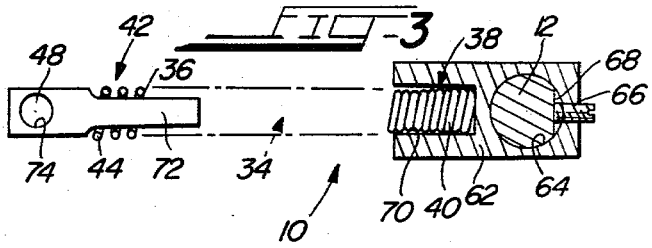
FIGS. 3–5 depict alternative embodiments of the apparatus shown in FIG. 1.
Figure 4:
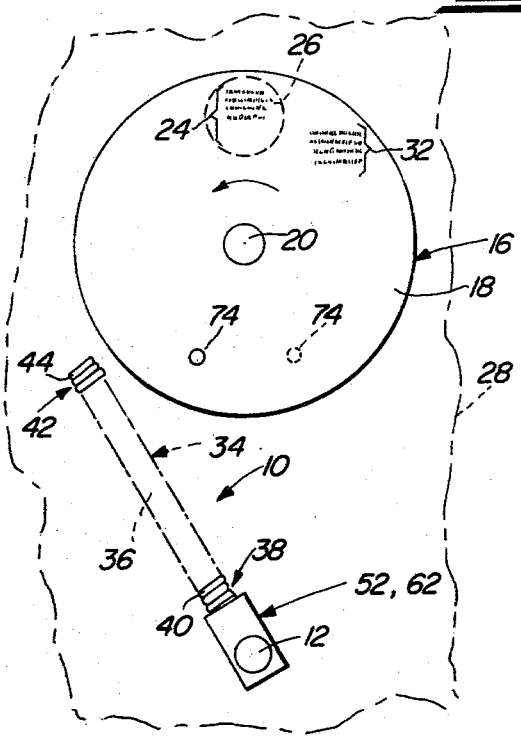
Figure 5:
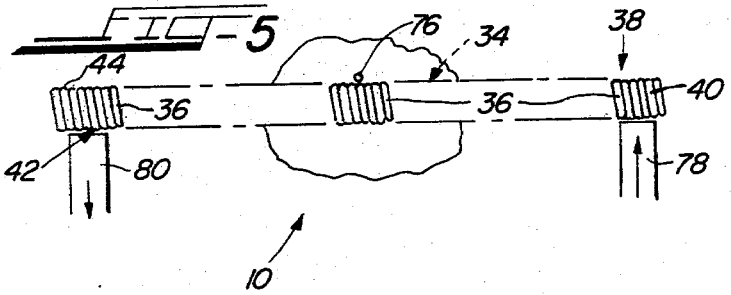

Accordingly, then, the apparatus 10 of the present invention includes an interconnecting member 34, such as a close-wound coil spring 36. The spring 36 may, as shown in FIGS. 1 or 3, be mounted to both the drive shaft 12 and the link 14. The spring 36 may also be connected to only one of the drive shaft 12 or the link 14, as shown in FIG. 4, or may be connected to neither, as shown in FIG. 5. Regardless of how the spring 36 is connected, it is preferred that movement of the spring 36, here effected by rotation of the drive shaft 12, be transverse.

A close-wound coil spring, such as that shown at 36, has a so-called "initial tension." Specifically, the spring 36 is formed by winding or twisting a length of wire into a helix so that the coils of the spring are urged together. The effect of forming the spring 36 in this manner is that no transverse flexing or bending of the spring 36 occurs until transverse forces applied to the spring exceed a certain level. If such a spring 36 has applied thereto sufficiently high transverse forces, it flexes or bends, as determined by its "spring rate," according to Hooke's Law, storing potential energy therein. The spring rate is determined by a number of factors, including the overall length and diameter of the spring 36, and the diameter and material of the wire from which the spring 36 is formed. Once the applied high forces are removed, the stored energy is released, unflexing or unbending the spring 36. If the transverse forces applied to the spring 36 are sufficiently low, the spring 36 acts as a rigid member.

Thus, in FIG. 1 if the drive shaft 12 moves slowly and if the link 14 and the disk 18 are both sufficiently freely rotatable and light, the spring 36 may well act as a rigid lever arm, so that rotation of the drive shaft 12 rotates the spring 36 transversely to reciprocate the link 14 directly, simultaneously, and in step with the rotation of the drive shaft 12. Stated differently, when the spring 36 acts as a rigid member, its ends move together. This type of movement of the spring 36 is referred to herein, and in the claims hereof, as "synchronous" and "isochronous." According to Webster's Third New International Dictionary, Unabridged Edition (1971), published by G. & C. Merriam Co., "synchronous" means "happening, existing or arising at the same time . . . operating at exactly the same periods . . . marked by exact coincidence in time rate or rhythm . . . having the same period and phase." "Isochronous" is defined as "equal in duration or interval." Thus, taking into consideration such factors as (a) the mass of the interconnecting member 34, of the shaft 12, and of the link 14 with the disk 18 connected hereto, (b) the amount of friction present at such locations as the pins 20 and 22, (c) the velocity at which the shaft 12 rotates, and (d) the kinetic energy developed by the shaft-member 12–34 system when the shaft 12 rotates, if the spring 36 does not flex or bend when the shaft 12 rotates, the link 14 is reciprocated at the same time and at a velocity directly proportional to the rotational velocity of the shaft 12. Moreover, the intervals of movement—initiation and cessation—of the link 14 and the shaft 12 are coincident. Synchronous and isochronous reciprocation of the link 14 rotates the disk 18 to alter the legend 24/32 visible through the window 26. In contrast, if the shaft 12 rotates sufficiently rapidly and violently, or if the link 14 or the disk 18 have sufficient mass, the spring 36 will deflect or bend storing potential energy therein. Thus, while that portion of the spring 36 directly mounted to the drive shaft 12 is moving with the drive shaft 12, the other portion of the spring 36 mounted to the link 14 "lags behind" this movement as potential energy is stored in the deflecting or bending spring 36. Subsequently, and possibly while the shaft 12 is still rotating, the stored potential energy in the spring 36 is released. The release of this energy tends to "straighten" or unbend the spring 36 and to move the link 14 to follow movement of the drive shaft 12. In other words, when the spring 36 flexes or bends, its ends do not move together. This type of movement of the spring 36 is referred to herein, and in the claims hereof, as "asynchronous" and "heterochronous." "Asynchronous" is defined as meaning "not simultaneous . . . not concurrent in time . . . opposed to synchronous," while "heterochronous" means "irregularity in time relationships" and is opposed to "isochronous." If factors such as (a)–(d), listed above, are again taken into account, if the spring 36 flexes or bends when the shaft 12 rotates, the link 14 begins to reciprocate at some time after the shaft 12 begins rotation and reaches its final position some time after the shaft 12 ceases rotation. The velocity of the link is proportional to the rate at which the energy stored in the spring 36 is released, not necessarily to the rotational velocity of the shaft 12.

Ultimately, the link 14 assumes one of its extreme positions to display the appropriate legend 24 or 32 through the windows 36. However, the bending or flexure of the spring 36 when the shaft 12 rotates rapidly limits the amount of force applied to the link 14 and, consequently, to the disk 18, thus preventing damage thereto. It has been found that in typical prior art arrangements in which a solid link rather than the spring 36 is used to interconnect the drive shaft 12 and the link 14, the high forces generated by the rapid rotation of the drive shaft 12 ultimately damage one or more of the elements depicted in FIG. 1 or the connections therebetween. Thus, up to a point determined by its "initial tension," the spring 36 acts as a rigid member. If rotation of the drive shaft 12 is sufficiently rapid so that, absent the spring 36, forces applied directly to the link 14 by a solid link would be such as to cause damage to the link 14 or to the disk 18, the spring 36 flexes or bends, limiting the amount of force applied to the link 14 and permitting the link 14 to move in a more "gentle" fashion as it follows the movement of the drive shaft 12.

The spring 36 has a first site 38 where it receives transverse force from the drive shaft 12. In the example of FIG. 1, this first site 38 is at or near one end 40 of the spring 36. The spring 36 also has a second site 42 whereat it applies force to the driven member or link 14. In the example of FIG. 1, the second site 42 constitutes an end 44 of the spring formed into a loop or eye 46 which is connected by a pin 48 of the link 14.

In FIG. 1, the end 40 of the spring 36 is threaded onto a threaded member 50. A split clamp 52 has a hole 54 therethrough for receiving the drive shaft 12. The split clamp 52 includes a pair of legs 56 and 58, the former of which contains a tapped hole for receiving the threaded member 50. The other leg 58 contains an untapped hole through which the threaded member 50 extends. A nut 60 may be run onto that portion of the threaded member 50 extending through the hole in the leg 58 to tighten the clamp 52 about the drive shaft 12 and to mount the end 40 of the spring 36 to the shaft 12 for transverse rotation therewith.

Figure 2A:
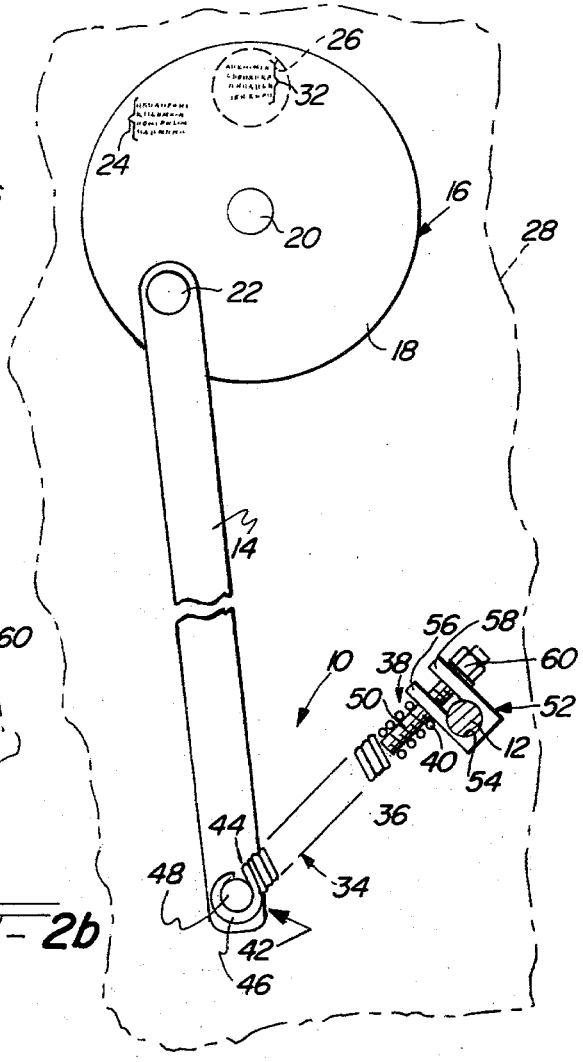
FIG. 2*a* and 2*b* depict the apparatus of FIG. 1 at various times during the operation thereof.

FIG. 2*a* illustrates what occurs when the drive shaft 12 rotates counterclockwise sufficiently slowly to permit the spring 36 to act as a rigid member. As can be seen in FIG. 2*a*, upon such slow rotation of the drive shaft 12, the spring 36 does not deflect, bend or flex, and moves the link 14 downwardly simultaneously, synchronously and isochronously with rotation of the drive shaft 12. Downward movement of the link 14 rotates the disk 18 on the pin 20 to move the legend 24 away from the window 26 and to move the legend 32 into alignment with the window 26. As noted previously, the legend 24 instructs the observer that the drive shaft 12 is in the position shown in FIG. 1, while the legend 32 instructs the observer that the drive shaft 12 is in the position depicted in FIG. 2*a*.

Figure 2B:
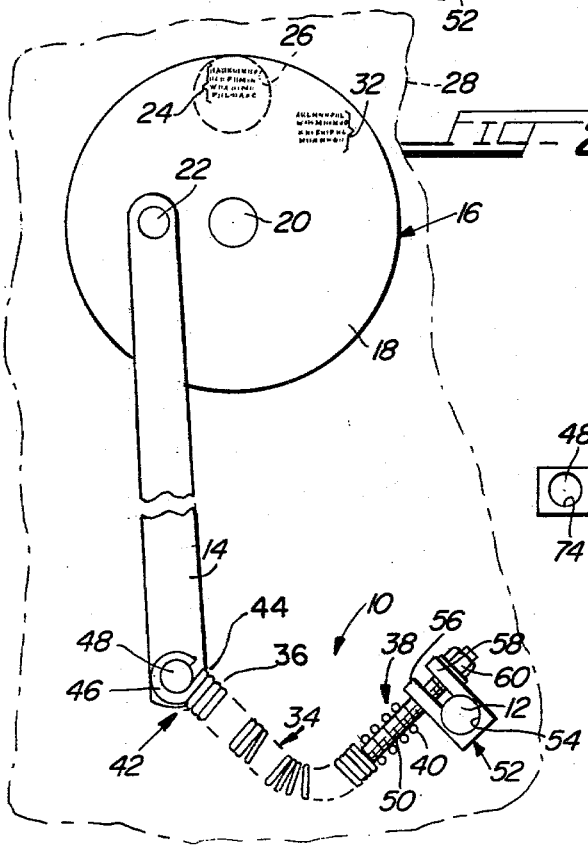

FIG. 2*b* illustrates the operation of the spring 36 when the forces applied thereto due to the rapid motion of the drive shaft 12 are sufficiently high to cause the spring 36 to flex or bend. In FIG. 2*b*, the rapid rotation of the drive shaft 12 has caused the spring 36 to bend or deflect; downward movement of the link 14 lags behind the corresponding rotation of the drive shaft 12. This bending or flexing of the spring 36 stores potential energy therein so that, as shown in FIG. 2*a*, the link 14 ultimately follows movement of the drive shaft 12 in an asynchronous and heterochronous manner due to the release of this potential energy.

In the embodiment of FIG. 3, the spring 36 is connected to the drive shaft 12 by a block 62. The block 62 contains a hole 64 which fits around the shaft 12. A set screw 66 is threaded into a threaded hole in the block 62 sufficiently far to engage a flat 68 formed on the shaft 12. The end of the spring 36 is threaded into a hole 70 in the block 62. In the embodiment of FIG. 3, the end 44 of the spring 36 is connected to the link 14 by a threaded stud 72 having a hole 74 formed through a flattened portion thereof for engagement by the pin 48 on the link 14.

FIG. 4 depicts an alternative embodiment wherein the end 40 of the spring 36 is connected to the drive shaft 12 in either of the ways depicted in FIGS. 1 or 3, but wherein the end 44 of the spring 36 is not directly connected to another member. Specifically in FIG. 4, the link 14 has been eliminated. The disk 18, which is otherwise similar to the disk 18 shown in FIG. 1, carries a projecting stud 74 which lies in the path of movement of the end 44 of the spring 36 as the shaft 12 rotates. The operation of the apparatus 10 shown in FIG. 4 is similar to that depicted in FIGS. 2*a* and 2*b*. If the rotational speed of the shaft 12 is sufficiently low, the second site 42, which is normally spaced from the stud 74, impinges on the stud 74 from either side to synchronously or isochronously rotate the disk 18 to a position indicative of the position of the drive shaft 12. If the rotational speed of the shaft 12 is sufficiently high, initial impingement between the second site 42 and the stud 74 causes the spring 36 to flex or bend, storing potential energy therein. The release of this potential energy "gently" moves the disk 18 to its intended position.

In FIGS. 1-4, the drive member is depicted as the drive shaft 12 which rotates. Also in FIGS. 1-4, the driven member is variously depicted as the reciprocable drive link 14 combined with the rotatable disk 18 (FIG. 1) or the rotatable disk 18 alone (FIG. 4). In FIG. 5, both the driven member and the drive member reciprocate. In FIG. 5, the spring 36 is mounted for free rotation on a pin 76. The pin 76 may be located at any point relative to the sites 38 and 42 and to the ends 40 and 44 of the spring 36. The drive member, in this case, a reciprocable member 78, is not directly connected to the spring 36, but rather, lies on the path of movement of the first site 38. Similarly, the driven member, another reciprocable member 80, is not directly connected to the second site 42, but rather, lies on the path of movement of the second site 41. As depicted in FIG. 5, upward movement of the drive member 78 causes it to contact the first site 38 to ultimately rotate the spring 36 on the pin 76. Rotation of the spring brings the second site 38 into contact with the driven member 80 for downward movement thereof. Similar to the description of the previous embodiments, the speed and violence with which the drive member 78 moves determine whether or not the spring 36 flexes and, in any event, limits the amount of force that is applied to the driven member 80 to obviate damage thereto.

In a most general aspect of the invention, the site 42 and the end 44 of the spring 36 alone or with a target or indicator thereon (not shown) may constitute the driven member. If the site 38 and the end 40 move sufficiently slowly, the driven member 42,44 move synchronously and isochronously therewith. If the site 38 and the end 40 move at a sufficiently high speed, and if the inertia of the driven member 42,44 is sufficiently high, movement of the latter will be asynchronous and heterochronous relative to the former.

I claim:

1. Force-limiting coupling apparatus for moving a driven member in response to movement of a drive member, the drive member being movable at high velocity between first and second rest positions of the drive member; the apparatus comprising:

a connecting link having first and second separated sites thereon, the link including:

first means responsive to movement of the drive member between the first rest position and the second rest position for moving the first site therewith between respective first and second locations;

second means responsive to movement of the second site between a first location and a second location for moving the driven member therewith between the respective first and second positions; and a member interconnecting the sites for moving the second site between its first and second locations synchronously and isochronously with the movement of the first site between its first and second locations if the velocity of the first site is less than a predetermined value, and, for moving the second site between its first and second locations asynchronously and heterochronously with movement of the first site between its first and second location if the velocity of the first site is greater than the predetermined value.

2. Apparatus as in claim 1, wherein the interconnecting member comprises a spring having a normal configuration.

3. Apparatus as in claim 2, wherein during movement of the first site at a velocity less than the predetermined value, the spring acts as a rigid member and remains in its normal configuration, and during movement of the first site at a velocity greater than the predetermined value, the spring acts as a non-rigid member and is distorted out of its normal configuration to store energy therein as the first site moves, release of the stored energy returning the spring to its normal configuration and moving the second site.

4. Apparatus as in claim 3, wherein the spring is a close-wound coil spring having an elongated major axis, the first means is an area of the first site to which the drive member applies force transversely of the axis of the spring during movement of the drive member between its first and second rest positions, the second means is an area of the second site which applies force transversely of the axis of the spring to the driven member during movement of the second site between its first and its second locations, and the distortion of the spring is characterized by transverse flexure and bending thereof.

5. Apparatus as in claim 4, wherein the drive member is a rotatable shaft, the first means mounts the spring near one end thereof to the shaft for transverse rotation therewith, the second site is near the other end of the spring, and the driven member lies in the path of rotation of the second site.

6. Apparatus as in claim 5, wherein the driven member is reciprocable.

7. Apparatus as in claim 6, wherein the second site is mounted to the reciprocable driven member.

8. Apparatus as in claim 5, wherein the driven member is rotatable.

9. Apparatus for moving a driven member in response to movement of a drive member, which may move suddenly at high speed, so that forces applied to the driven member do not exceed a predetermined value, which apparatus comprises:

an elongated member having a first force-receiving site thereon, the application of transverse force to the first site by the moving driven member transversely moving the elongated member, the first site and a second force-applying site thereon, the elongated member being flexible between the sites so that, if the sum of the transverse forces applied to the sites is less than the predetermined value, it does not flex, and, if the sum of the transverse forces applied to the sites exceeds the predetermined value, it flexes between the sites to store potential energy therein, release of the stored energy unflexing the elongated member; and means on the driven member and in the path of movement of the second site for receiving force therefrom to move the driven member, movement of the drive and driven members being simultaneous, synchronous and isochronous when the elongated member does not flex, movement of the driven member by release of the stored potential energy followed flexing of the elongated member lagging behind, and being asynchronous and heterochronous relative to, movement of the drive member.

10. Apparatus for moving a driven member in response to movement of a drive member, which may move suddenly at high speed, so that forces applied to the driven member do not exceed a predetermined value, which apparatus comprises:

an elongated member having a first force-receiving site thereon, the application of transverse force to the first site by the moving drive member transversely moving the elongated member, the first site and a second force-applying site thereon, the elongated member acting as a rigid member between the sites if the sum of the transverse forces applied to the sites is less than the predetermined value, the elongated member acting as a flexible member if the sum of transverse forces applied to the sites exceeds the predetermined value, flexing of the member between the sites storing potential energy therein, release of the stored energy unflexing the elongated member; and means on the driven member and in the path of movement of the second site for receiving force therefrom to move the driven member, movement of the drive and driven members being simultaneous, synchronous and isochronous when the elongated member does not flex, movement of the driven member by release of the stored potential energy following flexing of the elongated member lagging behind, and being asynchronous and heterochronous relative to, movement of the drive member.

11. Apparatus for moving a driven member in response to movement of a drive member, which may move suddenly at high speed, so that forces applied to the driven member are limited to prevent damage to the members, which apparatus comprises:

an elongated member having a first force-receiving site thereon, the application of transverse force to the first site by the moving drive member transversely moving the elongated member, the first site and a second force-applying site thereon, the elongated member acting as a rigid member between the sites as long as the forces applied to the members by the sites are less than a predetermined value, the elongated member acting as a flexible, energy-absorbing member when the forces applied to the sites exceed the predetermined value, flexing of the member between the sites storing potential energy therein and limiting the force applied to the driven member at any instant of time, release of the stored energy unflexing the elongated member; and means on the driven member and in the path of movement of the second site for receiving force therefrom to move the driven member, movement of the drive and driven members being simultaneous, synchronous and isochronous when the elongated member does not flex, movement of the driven member by release of the stored potential energy following flexing of the elongated member lagging behind, and being asynchronous and heterochronous relative to, movement of the driven member.

12. Apparatus as in claim 9, 10 or 11, wherein the elongated member is a coiled tension spring.

13. Apparatus as in claim 12, wherein the drive member is a rotatable shaft, and the first site is mounted to the shaft for transverse rotation of the spring.

14. Apparatus as in claim 13, wherein the driven member is a reciprocable link.

15. Apparatus as in claim 14, wherein the second site is mounted to the link for reciprocation thereof upon transverse rotation of the spring.

16. Apparatus as in claim 13, wherein the driven member is rotatable.

* * * * *